US006726072B2

(12) United States Patent
Rugh

(10) Patent No.: US 6,726,072 B2
(45) Date of Patent: Apr. 27, 2004

(54) REPOSITIONABLE CLIP FOR A HANDGUN

(75) Inventor: John B. Rugh, Chester Springs, PA (US)

(73) Assignee: Skyline Toolworks LLC, Malvern, PA (US)

( * ) Notice: Subject to any disclaimer, the term of this patent is extended or adjusted under 35 U.S.C. 154(b) by 129 days.

(21) Appl. No.: 10/105,914

(22) Filed: Mar. 25, 2002

(65) Prior Publication Data

US 2003/0178455 A1 Sep. 25, 2003

(51) Int. Cl.[7] ..... A45F 5/00

(52) U.S. Cl. ..... 224/269; 224/271; 224/912; 42/71.02; 42/106

(58) Field of Search ..... 224/269, 587, 224/198, 271, 191, 192, 666, 667, 668, 912; 24/3.11, 563; 42/71.02, 106

(56) References Cited

U.S. PATENT DOCUMENTS 694,969 A * 3/1902 Kemp ..... 42/71.02
2,320,450 A * 6/1943 Valenzuela ..... 42/106
2,903,810 A * 9/1959 Lewis ..... 42/71.02
3,128,571 A * 4/1964 Herrett ..... 42/71.02
3,156,059 A * 11/1964 Crain ..... 42/71.02
3,397,475 A * 8/1968 Mikus ..... 42/71.02
5,235,728 A * 8/1993 Nordberg ..... 224/667
5,511,706 A * 4/1996 Hendrickson ..... 224/269
5,630,535 A * 5/1997 Valenti ..... 224/269
5,664,292 A * 9/1997 Chen ..... 24/3.11
5,881,938 A * 3/1999 Wakefield ..... 224/587
5,927,579 A * 7/1999 Schwabe ..... 224/269
6,155,468 A 12/2000 Kinnich
6,264,079 B1 * 7/2001 Skaggs ..... 224/193

* cited by examiner

*Primary Examiner*—Nathan J. Newhouse
(74) *Attorney, Agent, or Firm*—William H. Eilberg

(57) ABSTRACT

A clip for a handgun allows the handgun to be carried either on a belt or in a holster. The clip includes a mounting plate, removably attached to the handgun, and a clip portion which is screwed onto the mounting plate. The mounting plate is preferably affixed to the handgun using a double-sided adhesive. The position of the mounting plate can be changed, and the mounting plate can also be moved to an entirely different handgun. The clip of the present invention can therefore be used with a wide variety of handguns. When the clip portion is attached, the handgun can be carried on a belt or other non-holstered holding device. When the clip portion is removed, the handgun can be stored in a holster, with the mounting plate still attached.

16 Claims, 8 Drawing Sheets

REPOSITIONABLE CLIP FOR A HANDGUN

BACKGROUND OF THE INVENTION

This invention relates to the field of firearms, and to handguns in particular. The invention provides a clip which can be used to carry the gun, and which is removable and repositionable so as to allow the clip to be used on a plurality of different guns.

There are many circumstances in which there is a legitimate need to carry a concealed weapon. For example, plain-clothes law enforcement officers need to carry firearms in an inconspicuous manner. Also, off-duty officers may need the same capability. But the same person who needs to conceal the weapon at certain times may also want to keep the weapon in a holster at other times, when concealment is not required.

It has been known to attach a clip to a handgun, so as to allow the handgun to be carried near the user's waist, with the clip engaging the user's belt. One example of such a clip is shown in U.S. Pat. No. 6,155,468.

Another product, sold under the trademark CLIPDRAW, and available from Skyline Toolworks LLC, of Malvern, Pa., provides a belt clip for carrying a handgun. The one-piece clip is screwed directly onto the handgun when it is desired to clip the gun to a belt, or removed therefrom when it is desired to carry the handgun in a holster.

A major problem with the CLIPDRAW product described above is its inflexibility. To use the product, one must use existing screw holes or drill and tap new screw holes into the handgun. Once attached, the CLIPDRAW product cannot be repositioned without drilling and tapping new holes. Thus, it is inconvenient to move the clip to a different position, or to a different handgun. Moreover, the structure of the prior art clip is such that it will fit only one size or type of handgun. As a result, the product must be provided in different sizes, to fit different handguns. In general, the prior art products intended for a specific handgun will not fit other guns.

The present invention provides a product and method making it feasible to use a single clip with a multiplicity of handguns, and also making it practical to change the position of the clip on a given handgun.

SUMMARY OF THE INVENTION

The clip of the present invention includes a flat mounting plate, and a clip portion that is attachable to the mounting plate. The mounting plate is removably attached to a surface of the handgun, the preferred means of attachment being a double-sided adhesive tape. The clip portion includes a pair of holes, and the mounting plate includes at least two holes, arranged in a series, and sized to match the holes of the clip portion. The position of the clip portion, relative to the mounting plate, can be chosen by aligning selected holes of the mounting plate with the holes of the clip portion. The clip portion and mounting plate are then screwed together.

In use, the mounting plate can be adhered to virtually any flat surface of any handgun, and the clip portion can be easily screwed onto the mounting plate. If necessary, one can reposition the clip, on the same handgun, by removing the mounting plate and adhering it at a different location. Alternatively, the mounting plate can be adhered to an entirely different handgun. Thus, the clip of the present invention can be used with a plurality of different types and sizes of handgun.

With the clip installed on the handgun, the handgun can be conveniently stored in a non-holstered manner, such as by suspending the clip from a belt or equivalent. When it is desired to store the gun in the holster, the clip portion can be conveniently removed, and the gun can be holstered with the mounting plate still attached, because the mounting plate is thin and does not interfere with the holster.

The present invention therefore has the primary object of providing a clip for attachment to a handgun.

The invention has the further object of providing a clip as described above, wherein the clip enables the handgun to be carried on a belt, or by some other non-holstered means.

The invention has the further object of enabling a user of a handgun to carry the handgun either on a belt or in a holster, and to switch between these two modes of storage with minimal effort.

The invention has the further object of providing a clip which can be used with many different sizes and styles of handguns.

The invention has the further object of providing a clip, as described above, wherein the clip is adjustable, so that the handgun can be carried either higher or lower on a belt, or other holding means.

The invention also includes a method of storing a handgun, wherein the handgun can be stored in either a concealed or open manner, and in which the degree of concealment can be varied.

The reader skilled in the art will recognize other objects and advantages of the present invention, from a reading of the following brief description of the drawings, the detailed description of the invention, and the appended claims.

DETAILED DESCRIPTION OF THE INVENTION

Figure 1:
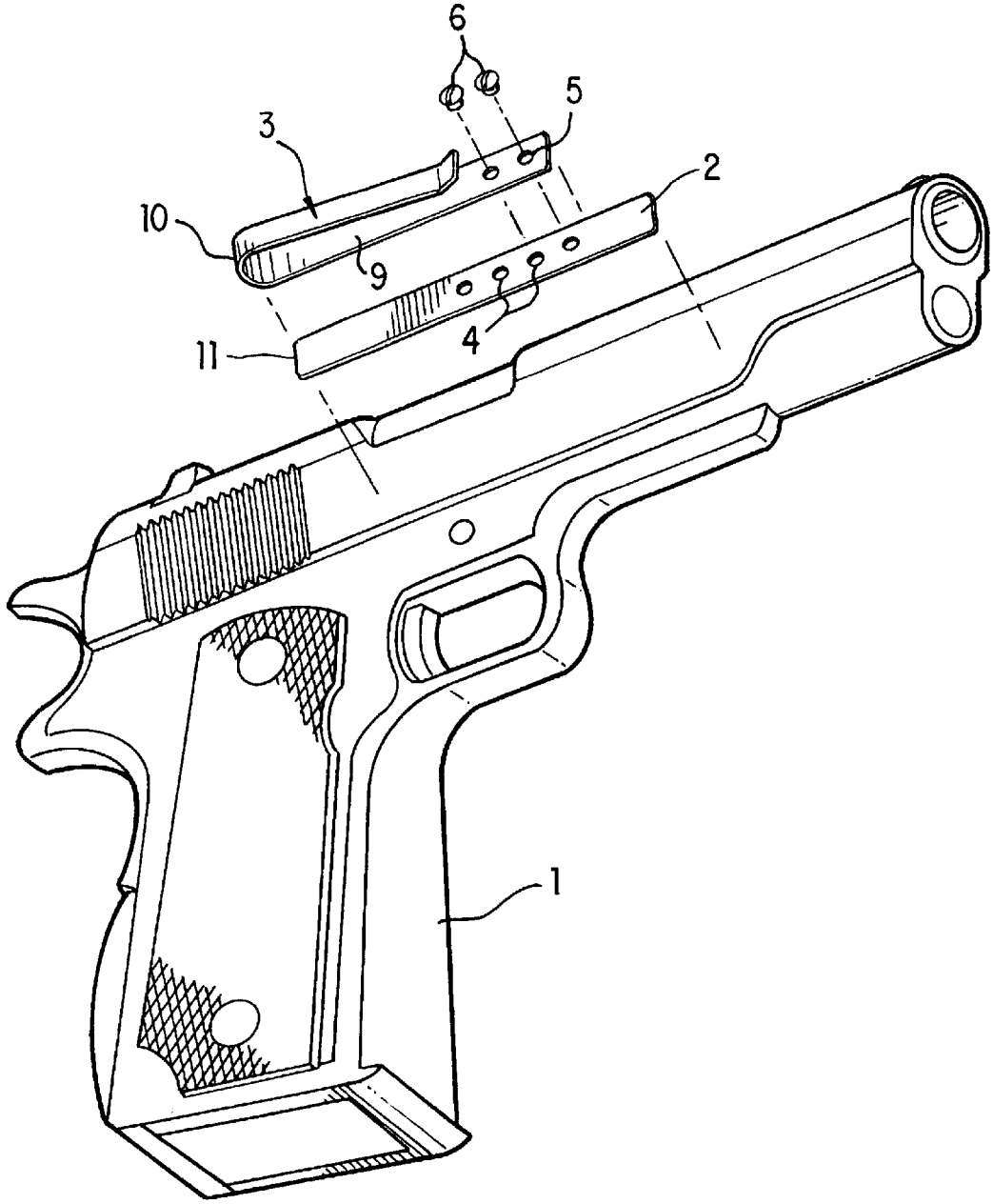
FIG. 1 provides an exploded perspective view, showing the clip of the present invention, in combination with a handgun.

FIG. 1 provides an exploded perspective view of the clip of the present invention, when used with a handgun. The figure shows handgun 1, shown as a semi-automatic pistol, mounting plate 2, and clip portion 3. As used in this specification, the term "clip" is intended to mean the combined clip structure which includes both the mounting plate 2 and the clip portion 3, while the term "clip portion" is used to designate only the element 3 which is removable from the mounting plate.

The mounting plate is generally flat, preferably made of metal, and capable of abutting a smooth surface, or a relatively smooth surface, of the handgun. The mounting plate includes a plurality of holes 4, arranged in a series. In the preferred embodiment, there are four holes; it is necessary that there be at least two holes. The clip portion, also preferably made of metal, includes a flat member 9 having a pair of holes 5 which are sized and spaced to become aligned with pairs of holes in the mounting plate. The flat member of the clip portion is affixed to the mounting plate by screws 6. The material used for forming the clip portion must be sufficiently resilient to allow the clip portion to function as a clip, i.e. to deform and return towards its initial position.

Figure 8:
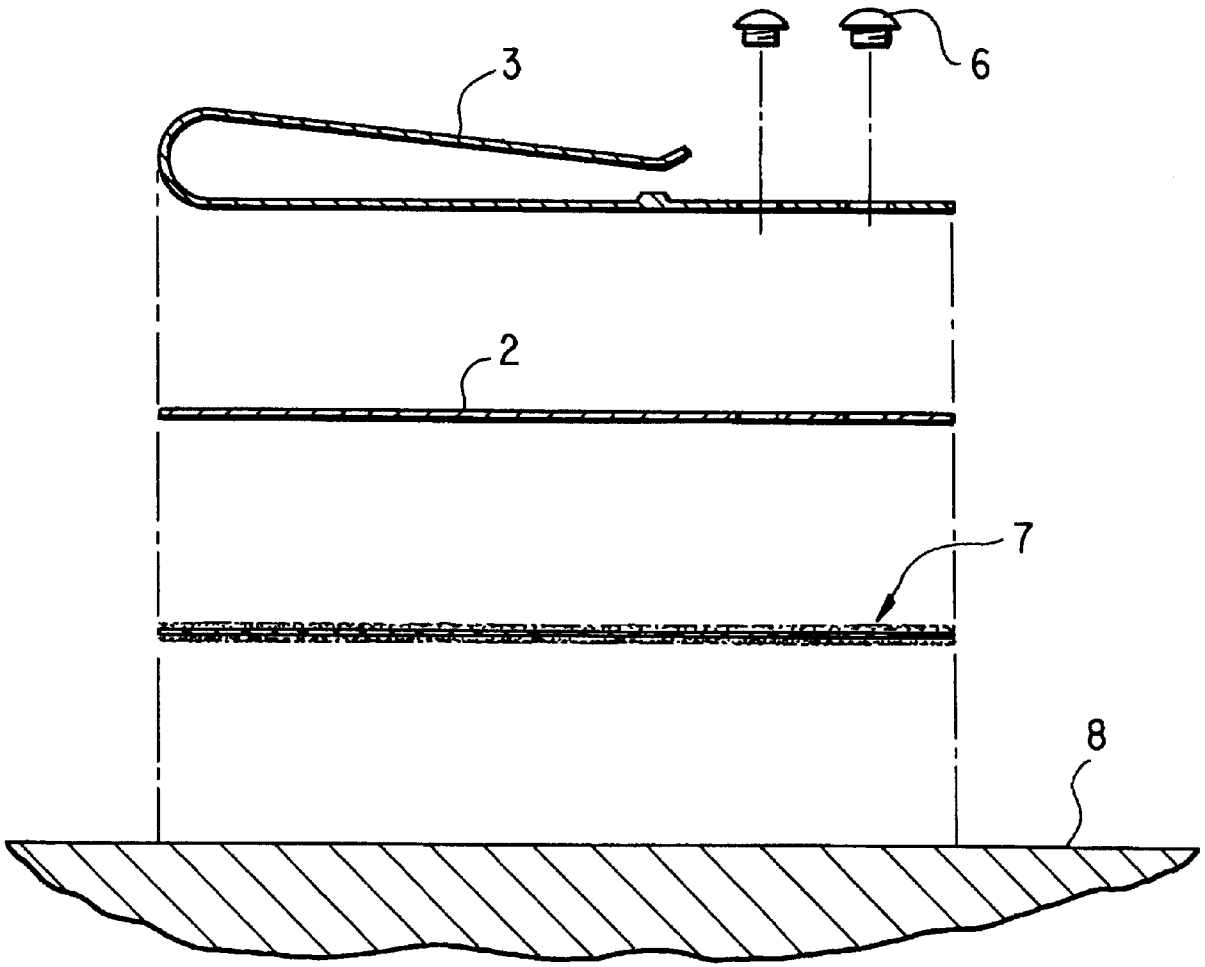
FIG. 8 provides an exploded cross-sectional view, illustrating the mounting of the clip of the present invention using a double-sided adhesive.

In the preferred embodiment, the mounting plate is affixed to the surface of the handgun using a double-sided adhesive, as illustrated in FIG. 8. FIG. 8 illustrates a fragment of surface 8 of the handgun, and shows double-sided tape 7, as well as the mounting plate 2, the clip portion 3, and the screws 6. The double-sided tape is formed of a plastic carrier having an adhesive material on either side of the carrier. A preferred type of double-sided tape that can be used with the present invention is manufactured by Minnesota Mining & Manufacturing Company, as Product No. 4936. The latter product is a double-coated acrylic tape, having a thickness of 0.025 inches. The strength of the adhesive bond increases with time, so if the mounting plate is left attached to the handgun, the degree of affixation will generally improve, not deteriorate, over time. The above-mentioned tape has been used in certain applications in the aircraft industry as a lightweight replacement for rivets, and is therefore strong enough to hold the mounting plate very firmly to the handgun. Although the above adhesive tape is preferred, other adhesives can be used instead, within the scope of the invention.

The position of the clip portion, relative to the mounting plate, can be adjusted, by choosing to align the pair of holes in the clip portion with a different pair of holes in the mounting plate. As long as there are more than two holes in the mounting plate, there will be some degree of choice. Thus, there may be more than four holes in the mounting plate, if desired. There could even be more than two holes in the clip portion. It is important that there be more than one hole in the clip portion, to insure that the clip portion cannot pivot relative to the mounting plate after installation.

The position of the left-hand region (i.e. the curved part 10) of the clip portion, relative to the mounting plate, is also important. The curved portion 10 should not be located to the right of the left-hand end 11 of the mounting plate, i.e. the mounting plate should not extend to the left of the clip portion. To do so would mean that the mounting plate might interfere with the safety mechanism of the handgun. Note that the positions of the holes, in both the mounting plate and the clip portion, as shown in FIG. 1, insure that the clip portion cannot be mounted in the improper position described above.

The double-sided adhesive described above could be replaced by a single layer of adhesive material. Moreover, one may use a repositionable adhesive, as long as it is strong enough to hold the mounting plate under the stresses of use.

Other means of attaching the mounting plate to the handgun may also be used. For example, the mounting plate could be magnetic, and could be held against the handgun, in a repositionable manner, by magnetism.

Figure 2:
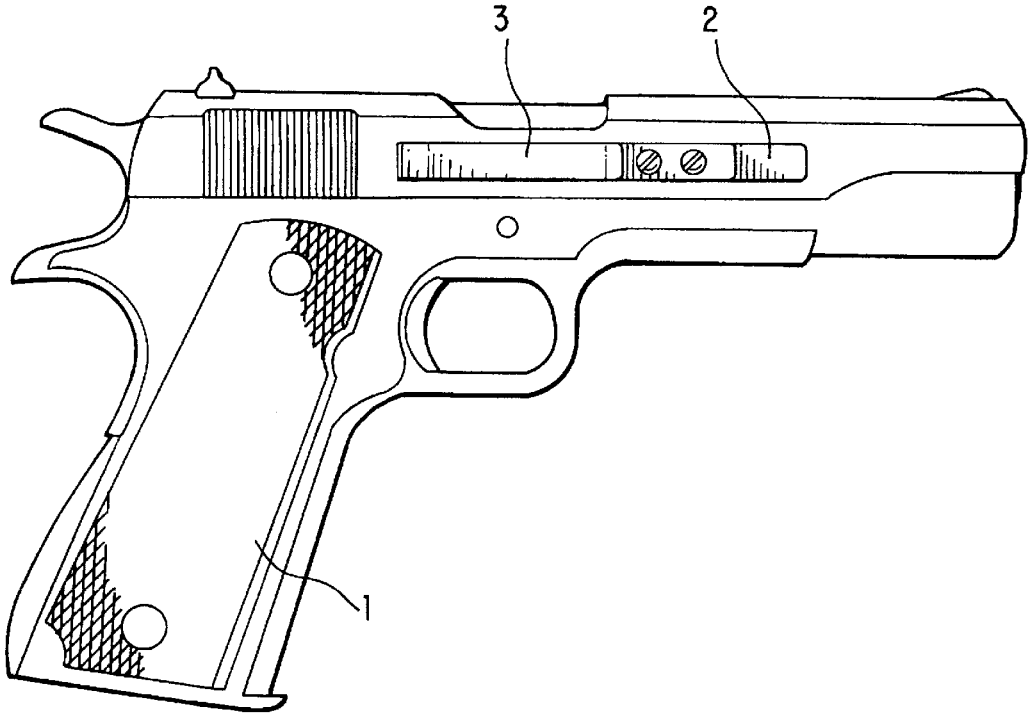
FIG. 2 provides a side elevational view of a handgun with the clip of the present invention installed.
Figure 3:
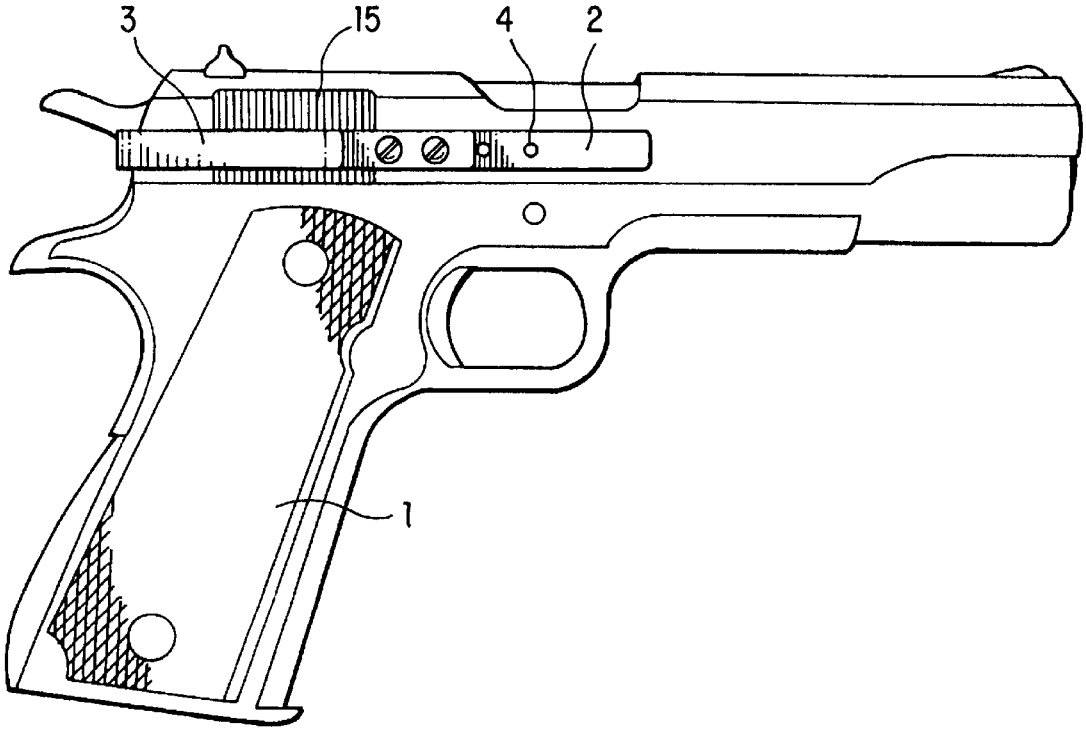
FIG. 3 provides a side elevational view similar to that of FIG. 2, except that the clip has been installed farther to the rear of the handgun.

FIGS. 2 and 3 together illustrate the repositioning of the clip of the present invention, and the adjustability of the clip portion relative to the mounting plate. In FIG. 2, the mounting plate 2 is affixed to handgun 1 at a position which is further forward, as compared with its position in FIG. 3. Also, in FIG. 2, the clip portion 3 is mounted at the most forward permissible position relative to the mounting plate, while in FIG. 3, the clip portion is mounted at the rearmost permissible position. Note that, in FIG. 3, the two forward holes 4 of the mounting plate are visible and unused.

The amount of adjustability depends on the number and size of the holes. In the preferred embodiment, it is desirable to be able to move the clip portion forward or back by up to about one-half inch. Thus, the clip portion can be positioned to compensate for variations in the type of clothing worn by a particular user, or variations in the thickness of the belt. In all cases, the clip portion can be adjusted without removing the mounting plate. On the other hand, major repositioning of the clip can be accomplished by repositioning the mounting plate.

Although the handgun shown in FIGS. 1–3 has a grooved portion 15, this grooved portion does not interfere with the placement of the mounting plate. In general, by positioning the clip portion further to the rear of the handgun, one makes it possible to carry the handgun lower, i.e. more deeply, on a belt. The depth to which the handgun is carried determines the degree to which the weapon can be concealed.

Figure 4:
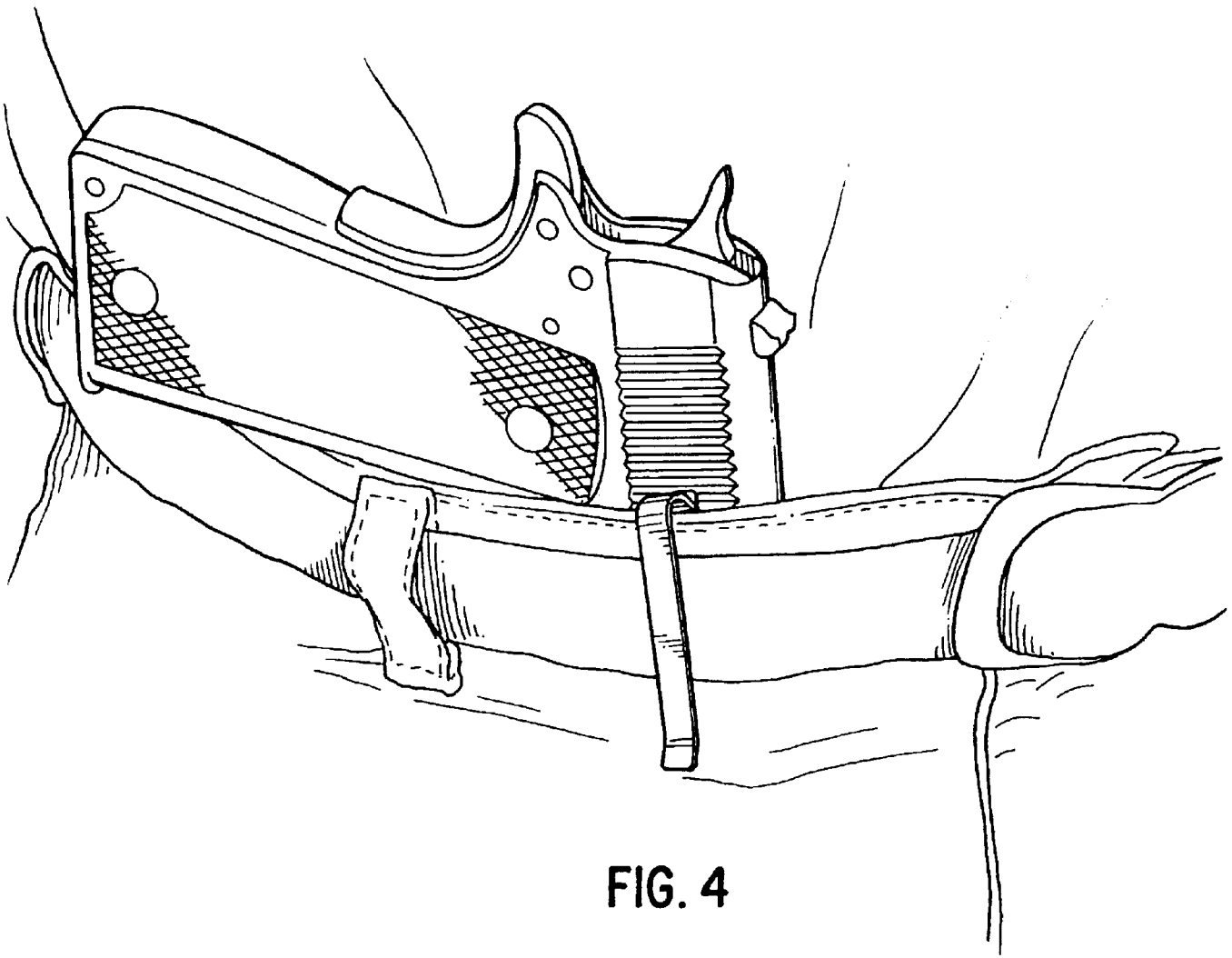
FIG. 4 provides a perspective view, showing the use of the clip of the present invention to support a handgun on a wearer's belt.

The carrying of the handgun on a belt is illustrated in FIG. 4. If the clip portion is positioned further to the rear of the handgun, less of the handgun will, in general, be visible. If the clip portion is moved farther to the front of the handgun, more of the weapon will be visible.

Figure 5:
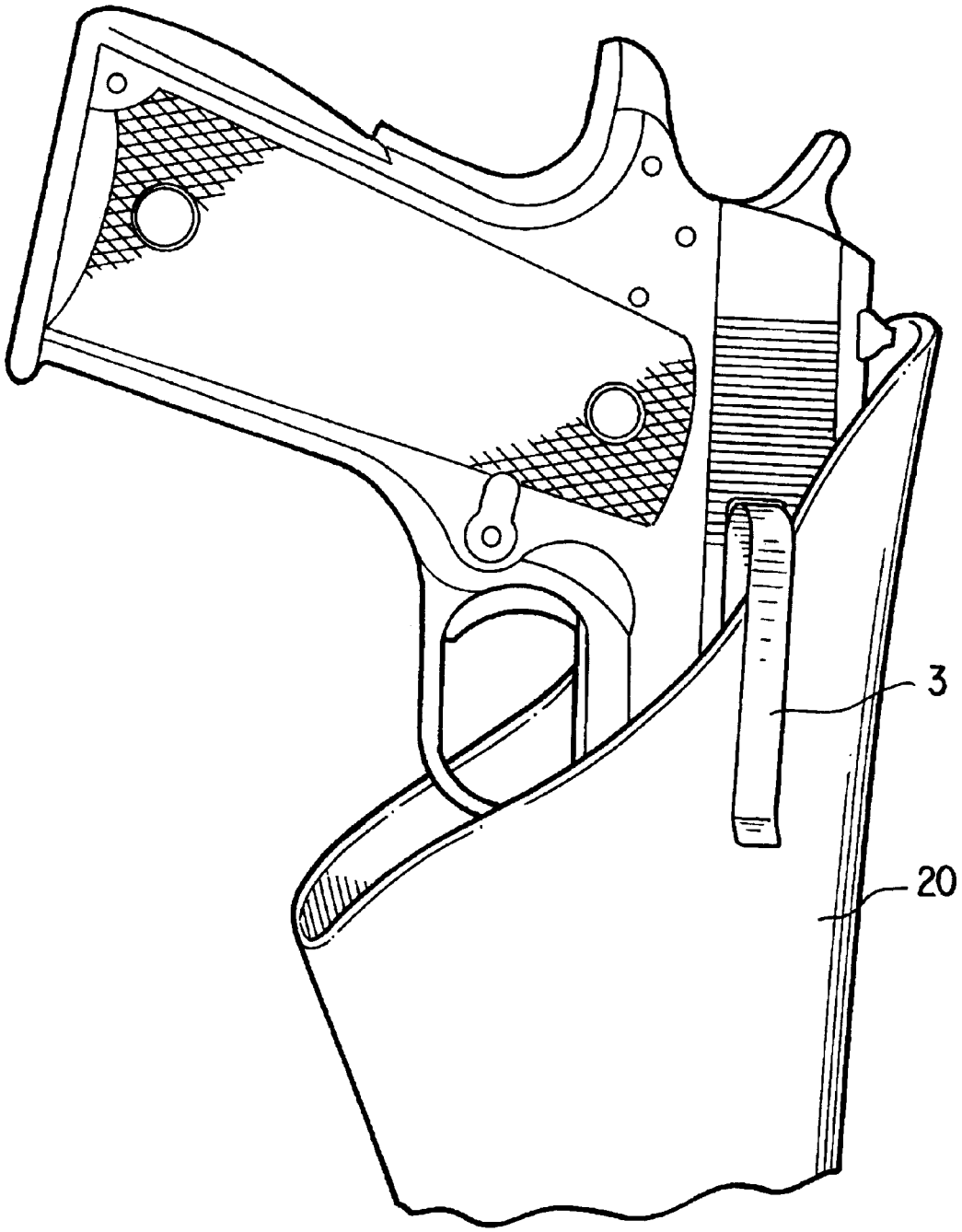
FIG. 5 provides a side elevational view, showing the clip of the present invention installed on a handgun which is partially inserted into a holster.
Figure 6:
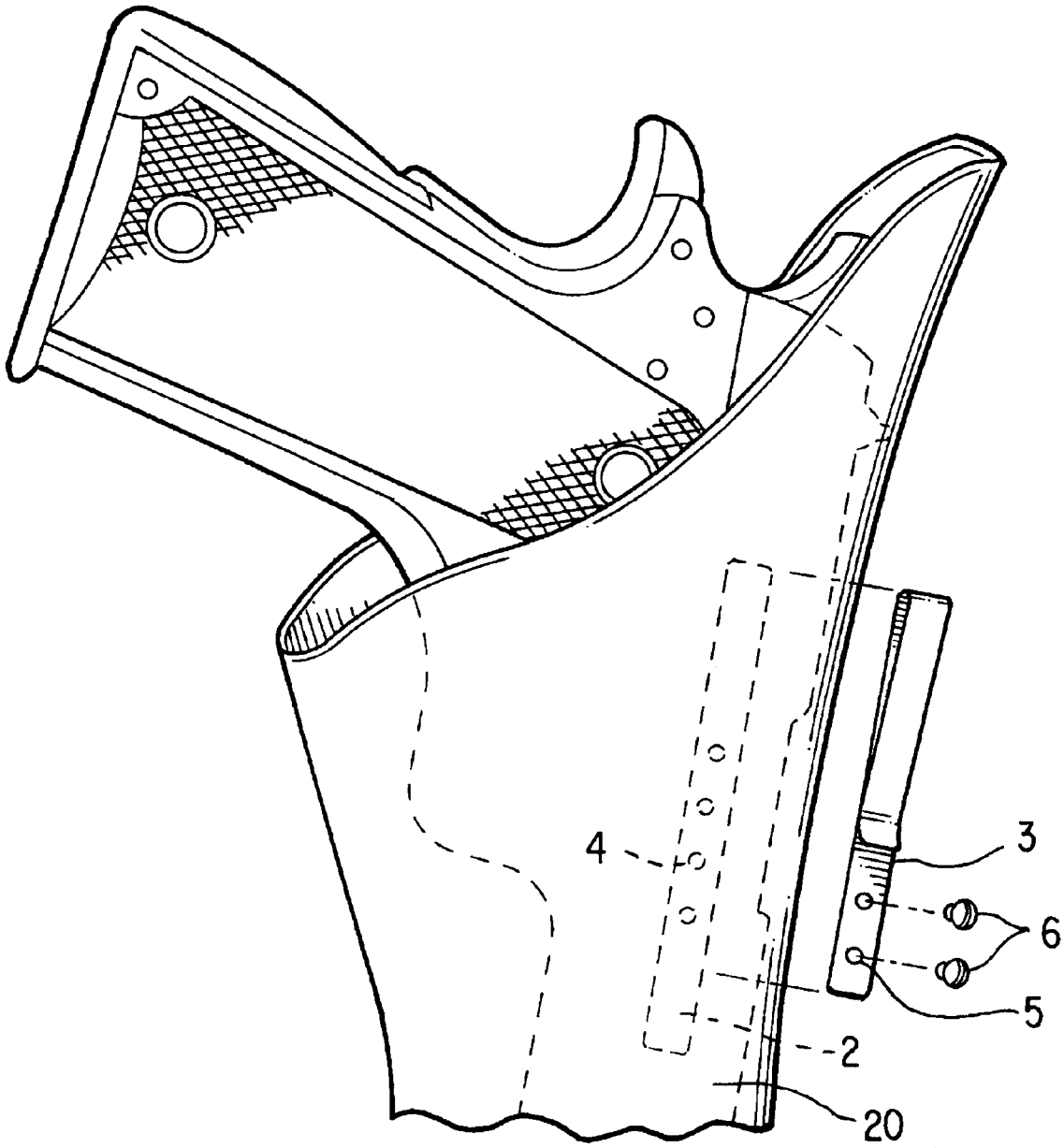
FIG. 6 provides a view similar to that of FIG. 5, except that part of the clip has been removed, so that the handgun can extend further into the holster.

FIGS. 5 and 6 show the handgun mounted in holster 20. In FIG. 5, the clip of the present invention is fully installed, the clip portion 3 being visible in the figure. In this position, the handgun does not fit fully into the holster, and the holster cannot be closed, because the clip portion interferes with the insertion of the gun. In FIG. 6, the screws 6 have been removed, so that the clip portion 3 is no longer attached to the mounting plate 2. The mounting plate is intended to remain with the handgun for extended periods of time, perhaps indefinitely. In this configuration, the handgun can be fully inserted into the holster.

Thus, by simply attaching or removing two screws, one can reconfigure the handgun so that it can either be conveniently carried in a holster or easily carried on a belt, in a boot, or in an equivalent manner. The mounting plate is sufficiently thin that it is, for practical purposes, level with the surface of the handgun, and does not interfere with the insertion of the handgun into the holster. In one example, the thickness of the mounting plate can be about 0.06 inches. The latter is given only as an example, and should not be interpreted to limit the invention.

Figure 7:
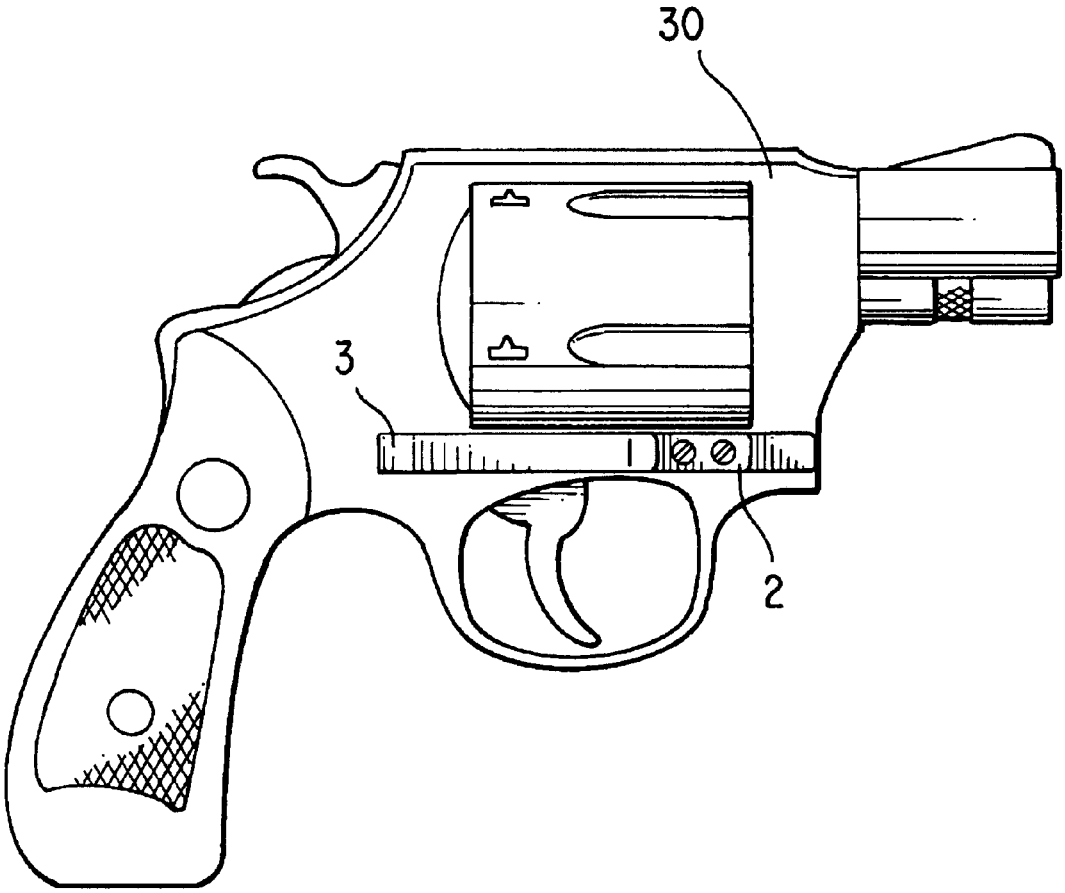
FIG. 7 provides a side elevational view showing the use of the clip of the present invention on a different type of handgun, namely a revolver.

FIG. 7 shows the clip of the present invention, as installed on a revolver 30. The figure illustrates the principle that the clip of the present invention can be used on virtually any handgun, regardless of size or type, as long as there is some flat surface portion capable of receiving the mounting plate.

The invention therefore includes not only the clip itself, but also a method of carrying a handgun. According to this method, one selects a position, on the surface of the handgun, for affixation of the mounting plate. The mounting plate is then adhered to the surface, such as by using a double-sided adhesive tape. Then, one attaches the clip portion to the mounting plate. Finally, one suspends the handgun, by the attached clip portion, from a non-holstered holding device such as a belt.

The method may then include removing the clip portion from the mounting plate, and inserting the handgun into a holster, the mounting plate remaining on the handgun.

The method may also include the step of repositioning the mounting plate on the same handgun, or removing the clip portion from the mounting plate and the mounting plate from the handgun, and re-installing the mounting plate, followed by the clip portion, on a different handgun. For example, as shown in the drawings, the clip can be moved from a semi-automatic pistol to a revolver, or vice versa.

The preferred means of attachment of the clip portion to the mounting plate is by screws, but other means are possible. The preferred means of attachment of the mounting plate to the surface of the handgun is through a double-sided adhesive, but other means are possible, such as magnetic attachment, within the scope of the invention.

The method may also include the step of choosing a position for the clip portion, relative to the mounting plate, and aligning the holes in the clip portion with appropriate holes in the mounting plate, so as to achieve the desired position of the clip portion.

An important advantage of the present invention is that it provides two different forms of adjustability. First, the location of the overall clip can be adjusted by choosing the position of the mounting plate. The mounting plate can be adhesively affixed to any flat surface, or nearly flat surface, of the handgun. Secondly, the position of the clip portion, relative to the mounting plate, can also be adjusted, simply by choosing the appropriate pairs of holes to be aligned. Varying the overall location of the clip permits the gun to be positioned higher or lower in the waistband or boot. Higher positioning is preferred for easiest access and shortest reaction time when drawing and firing. Lower positioning is preferred for optimum concealment.

Another advantage of the present invention is that it does not interfere with the storage of the gun in a holster. Gun clips of the prior art are not compatible with holsters. It is important that a gun clip work with a holster, because many law enforcement professionals use a holster when on duty, but carry the weapon concealed, while off duty. With clips of the prior art, such persons must remove and reinstall the clip each day. With the present invention, the mounting plate can remain on the handgun indefinitely, without interfering with the holster, while only the clip portion need be removed and re-attached.

Another advantage of the clip of the present invention is that it can, in general, be mounted on either side of a handgun, as long as there is a reasonably smooth surface available. This feature is important for left-handed users who may wish to mount the clip on the opposite side of the handgun as compared with right-handed users.

The invention may be modified in various ways. The length and number of holes in the mounting plate may be changed, thereby affecting the degree of adjustability of the device. The materials used to form the mounting plate and/or clip portion can be changed, and the adhesive used to attach the mounting plate may be varied. As noted above, other means of removable attachment of the mounting plate may be used instead of the double-sided tape or magnetic attachment. The invention is not limited to use with semi-automatic pistols and revolvers, but can be used with virtually any handgun. These and other modifications, which will be apparent to the reader skilled in the art, should be considered within the spirit and scope of the following claims.

What is claimed is:

1. In combination, a handgun, a mounting plate, and a clip portion, the mounting plate being adhered to a surface of the handgun, the mounting plate having at least two holes, the clip portion having a flat member in abutment with the mounting plate, the flat member having a pair of holes, each of the holes of the flat member being of a generally same size as the holes of the mounting plate, the clip portion also including a clip member integrally formed with the flat member, wherein the clip portion is removably attached to the mounting plate through screws inserted through said holes, wherein the screws do not penetrate the surface of the handgun.

2. The combination of claim 1, wherein the mounting plate is adhered to the surface of the handgun with a double-sided adhesive tape.

3. A handgun and a clip attached to the handgun, the clip comprising a mounting plate and a clip portion, the mounting plate being affixed to the handgun solely by an adhesive, the clip portion being attached to the mounting plate by a plurality of screws, wherein the screws do not penetrate the handgun.

4. A handgun and a clip attached to the handgun, the clip comprising a mounting plate and a clip portion, the mounting plate being affixed to the handgun solely by a double-sided adhesive, the mounting plate having a plurality of holes arranged in a series, the clip portion including a flat member having at least two holes sized and positioned to coincide with a pair of holes in the mounting plate, the flat member of the clip portion being attached to the mounting plate by a plurality of screws, wherein the screws do not penetrate the handgun.

5. A method of carrying a handgun, comprising:

a) selecting a position, on a surface of the handgun, for affixation of a mounting plate, the mounting plate being generally flat and having a plurality of holes, b) adhering the mounting plate to the surface of the handgun without penetrating the surface of the handgun, c) attaching a clip portion to the mounting plate by threading a pair of screws through holes in the clip portion and into the holes in the mounting plate without penetrating the surface of the handgun, and d) suspending the handgun, by the attached clip portion, from a holding means.

6. The method of claim 5, wherein the suspending step comprises suspending the handgun from a belt.

7. The method of claim 5, wherein the adhering step comprises placing a double-sided adhesive on the surface of the handgun, and affixing the mounting plate to the double-sided adhesive.

8. The method of claim 5, wherein the attaching step is preceded by the step of selecting a desired position of the clip portion relative to the mounting plate, and aligning holes in the clip portion with holes in the mounting plate so as to achieve said desired position.

9. The method of claim 5, further comprising the step of removing the clip portion from the mounting plate by removing said screws, and inserting the handgun, together with the adhered mounting plate, into a holster.

10. The method of claim 9, further comprising the step of repositioning the mounting plate on the handgun.

11. A method of carrying a handgun, comprising:

a) selecting a position, on a surface of the handgun, for affixation of a mounting plate, b) adhering the mounting plate to the surface of the handgun, at the selected position, the adhering step being performed without penetrating the surface of the handgun, c) attaching a clip portion to the mounting plate without penetrating the surface of the handgun, and d) suspending the handgun, by the attached clip portion, from a non-holstered holding device.

12. The method of claim 11, wherein the adhering step comprises placing a double-sided adhesive on the surface of the handgun, and affixing the mounting plate to the double-sided adhesive.

13. The method of claim 11, further comprising the step of removing the clip portion from the mounting plate, and inserting the handgun, together with the adhered mounting plate, into a holster.

14. The method of claim 13, further comprising the step of repositioning the mounting plate on the handgun.

15. A method of carrying a handgun, comprising:

a) selecting a position, on a surface of the handgun, for affixation of a mounting plate, b) adhering the mounting plate to the surface of the handgun, at the selected position, the adhering step being performed without penetrating the surface of the handgun, c) attaching a clip portion to the mounting plate without penetrating the surface of the handgun, d) suspending the handgun, by the attached clip portion, from a non-holstered holding device, e) removing the clip portion and mounting plate from the handgun, and repeating steps (a) through (d) for a different handgun.

16. A handgun and a clip attached to the handgun, the clip comprising a mounting plate and a clip portion, the mounting plate being affixed to the handgun solely by non-penetrating means, the clip portion being attached to the mounting plate by a plurality of screws, wherein the screws do not penetrate the handgun.

* * * * *